US007850108B2

(12) United States Patent
Olsson et al.

(10) Patent No.: US 7,850,108 B2
(45) Date of Patent: Dec. 14, 2010

(54) METHOD AND DEVICE FOR CLAMPING OF CRUSHING SHELL

(75) Inventors: Gert-Åke Olsson, Bara (SE); Rolf Silfver, Beddingestrand (SE); Torbjörn Nilsson Wulff, Svedala (SE)

(73) Assignee: Sandvik Intellectual Property AB, Sandviken (SE)

( * ) Notice: Subject to any disclaimer, the term of this patent is extended or adjusted under 35 U.S.C. 154(b) by 936 days.

(21) Appl. No.: 10/560,784

(22) PCT Filed: Jun. 11, 2004

(86) PCT No.: PCT/SE2004/009008

§ 371 (c)(1),
(2), (4) Date: Mar. 22, 2007

(87) PCT Pub. No.: WO2004/110626

PCT Pub. Date: Dec. 23, 2004

(65) Prior Publication Data

US 2007/0272780 A1 Nov. 29, 2007

(30) Foreign Application Priority Data

Jun. 18, 2003 (SE) ..... 03011763

(51) Int. Cl.
*B02C 2/00* (2006.01)

(52) U.S. Cl. ..... 241/207

(58) Field of Classification Search ..... 241/207, 241/209, 215, 244

See application file for complete search history.

(56) References Cited

U.S. PATENT DOCUMENTS

| | | | | | |
|---|---|---|---|---|---|
| 2,161,096 | A | * | 6/1939 | Schieferstein | 241/206 |
| 2,341,543 | A | * | 2/1944 | Gruender | 241/207 |
| 2,941,732 | A | * | 6/1960 | Cross et al. | 241/101.3 |
| 3,759,453 | A | * | 9/1973 | Johnson | 241/207 |
| 4,615,491 | A | | 10/1986 | Batch et al. | |
| 6,007,009 | A | | 12/1999 | Sheridan et al. | |
| 6,129,297 | A | * | 10/2000 | Sawant et al. | 241/101.3 |

FOREIGN PATENT DOCUMENTS

| | | |
|---|---|---|
| GB | 746655 | 3/1956 |

* cited by examiner

*Primary Examiner*—Faye Francis
(74) *Attorney, Agent, or Firm*—Drinker Biddle & Reath LLP

(57) ABSTRACT

A gyratory crusher includes an outer shell, which should be fastened in a frame included in the crusher, and an inner shell, which is intended to be fastened on a crushing head and to define together with the outer shell a crushing gap for receipt of material to be crushed. Upon fastening of the outer shell a first abutment surface on the outer periphery of the outer shell is brought in a first step to abutment against a first contact surface on the frame. In a second step a spacer member is pressed in for clamping of the outer shell between a second surface on the outer periphery of the outer shell and the frame. A good abutment is provided both at the first abutment. Surface of the outer shell and at the second abutment surface thereof.

14 Claims, 9 Drawing Sheets

METHOD AND DEVICE FOR CLAMPING OF CRUSHING SHELL

TECHNICAL AREA

The present invention relates to a method to fasten an outer shell in a gyratory crusher, which comprises the outer shell, which is to be fastened in a frame included in the crusher, and an inner shell, which is intended to be fastened on a crushing head and together with the outer shell define a crushing gap for receipt of material which is to be crushed.

The present invention also relates to an outer shell for fixing in a gyratory crusher.

The invention also relates to a gyratory crusher, which is of the above-mentioned kind and in which an outer shell can be fixed.

The invention also relates to a spacer member for use in the fixing of an outer shell in a gyratory crusher.

TECHNICAL BACKGROUND

A gyratory crusher, which is of the above-mentioned kind, can be utilized for crushing hard objects, for instance blocks of stone. During the crushing, the shells of the crusher are worn and these therefore have to be exchanged at regular intervals. Another reason for exchange of shell is that it is desired to alter the geometry of the crushing gap, which is formed between the outer shell and the inner shell.

U.S. Pat. No. 6,007,009 discloses a device for the fastening of an outer shell, which has an upper fixing flange, in a gyratory crusher. Special locking devices may be fastened in recesses in an upper part included in the crusher. The locking devices are then put in engagement with the fixing flange of the outer shell and are then clamped in order to press the outer shell against the upper part.

The locking devices disclosed in U.S. Pat. No. 6,007,009 are, however, mechanically complicated and involve a mechanically seen weak fixing of the outer shell.

SUMMARY OF THE INVENTION

An object of the present invention is to provide a method to fix an outer shell in a gyratory crusher, which method enables a flexible and robust fixing of the shell.

This object is attained by a method to fasten an outer shell in a gyratory crusher, which method is characterized in that in a first step a first abutment surface on the outer periphery of the outer shell is brought to abutment against a first contact surface on the frame, and that in a second step a spacer member for clamping of the outer shell is pressed in between a second abutment surface on the outer periphery of the outer shell and the frame. This method has the advantage that a very stable fixing of the outer shell is provided. The two abutment surfaces have the advantage that relatively limited portions of the outer shell have to be machined to accurate tolerances. The first and the second abutment surface may be machined to different angles to the vertical plane, which gives a possibility of choosing angles that are optimal for the position in question on the periphery of the outer shell. The fact that the fixing is made in two steps makes it easier to provide a good abutment both at the first and the second abutment surface. In particular, the invention has the advantage that it becomes simple to provide a good metallic abutment at both the first and the second abutment surface. A metallic abutment is mechanically stable and is also preferred from a working environment point of view.

Preferably said abutment surface is located at the lower end of the outer shell seen in a material flow direction, said second abutment surface being situated closer to the upper end of the outer shell seen in the material flow direction. The greatest crushing forces usually arise at the end of the crushing, i.e., in the lower end of the outer shell seen in the material flow direction. The first abutment surface gets in this way a very stable abutment and can in the best way withstand the crushing forces in the lower portion of the crusher.

Preferably in the second step, the spacer member is pressed in between the second abutment surface and the frame in the direction towards the first contact surface. This type of pressing-in is simple upon assembly and gives a clamping of the outer shell, which clamps it inwardly against the inner shell so that the outer shell in a good way can carry crushing forces and transfer these to the frame.

According to a preferred embodiment, in the first step the outer shell is secured after the first abutment surface thereof having been brought to abutment against the first contact surface of the frame, in the second step the spacer member being secured after it having been pressed in between the second abutment surface of the outer shell and the frame. An advantage of this is that the abutment between the first abutment surface and the first contact surface is not influenced when the second step is carried out.

Conveniently, the spacer member has a first sliding surface and a second sliding surface opposite the first sliding surface, the first sliding surface sliding against the second contact surface of the outer shell and the second sliding surface sliding against a second contact surface on the frame when the spacer member is pressed in. An advantage of this is that it becomes simple to press in the spacer member to give a good abutment against outer shell and frame and thereby a robust fixing of the outer shell.

Another object of the present invention is to provide an outer shell for fixing in a gyratory crusher, which outer shell enables a flexible fixing, which is robust during crushing.

This object is attained by an outer shell for fixing in a gyratory crusher, which outer shell is characterized in that it has a first abutment surface, which is arranged to, in a first fixing step, be brought to abutment against a first contact surface on the frame, and a second abutment surface that is arranged to, in a second fixing step, be brought in engagement with a spacer member that is possible to press in between the frame and the second abutment surface.

An advantage of this outer shell is that it is simple to manufacture since two relatively limited abutment surfaces have to be machined to high accuracy of tolerance. The abutment surfaces may also form different angles to the vertical plane. Thus, the angle for each one of the two abutment surfaces may be adapted to the conditions as regards, for instance, direction of crushing forces that are expected at the abutment surface in question. The outer shell will also well withstand mechanical load during the crushing thanks to the two abutment surfaces, which are brought to abutment in two steps.

Preferably, the second abutment surface forms an angle to the vertical plane of 0-20 degrees and is arranged to slide against a first sliding surface on the spacer member. Advantages of this angle are that it is simple to produce in casting of the outer shell, that it is convenient in respect of the crushing forces which arise in crushing and that it entails that the spacer member can slide against the second abutment surface upon the pressing-in. A small angle also has the advantage that the upwardly directed load becomes small on the members, for instance a flange and bolts, which hold the spacer member in place. According to an even more preferred embodiment, the second abutment surface is substantially perpendicular to the main direction of the crushing forces that during operation arise in plane with the second abutment surface. An advantage of this is that the crushing forces efficiently are transferred from the outer shell to the spacer member without causing considerable forces in the vertical direction. According to an even more preferred embodiment, the second abutment surface forms an angle of 5-15 degrees to the vertical plane. Such an angle gives a flexible pressing-in of the spacer member and a good clamping of the outer shell since the outer shell is clamped inwardly against the inner shell.

Preferably, the first abutment surface forms an angle to the vertical plane of 10-55 degrees, preferably such an angle that the first abutment surface forms substantially a right angle to the main direction of the crushing forces that during operation arise in plane with the first abutment surface. This angle is simple to produce in casting of the outer shell and gives a good transfer of the crushing forces from the outer shell to the frame without any considerable vertical forces arising.

According to a preferred embodiment, the second abutment surface is located substantially on a level with the portions of the periphery of the outer shell that surround the second abutment surface. Thus, an outer shell of this type lacks protruding portions, such as, for instance, ribs, and is therefore simple to cast. The raw material that is used for casting the outer shell is efficiently utilized since no raw material is lost on ribs or other protruding portions. A shell the wear surfaces of which has become worn down will thereby not have a high scrap weight, which largely consists of ribs.

An additional object of the present invention is to provide a gyratory crusher in which an outer shell can be fixed simply and robustly.

This object is attained by a gyratory crusher, which is of the above-mentioned type and which is characterized in that the outer shell of the crusher has a first abutment surface, which is arranged to, in a first fixing step, be brought to abutment against a first contact surface on the frame, and a second abutment surface that is arranged to, in a second fixing step, be brought in engagement with a spacer member which is pressed in between the frame and the second abutment surface. An advantage of this gyratory crusher is that the fixing of the outer shell becomes simple and that the outer shell gets a stable and robust fixing. This decreases the risk of damage on the outer shell and the frame during operation of the crusher. It also becomes simple to exchange a worn outer shell for a new.

According to a preferred embodiment, the spacer member is an intermediate ring, which has a substantially tubular part, which is intended to be pressed in between the second abutment surface of the outer shell and a second contact surface on the frame. The intermediate ring is easy to manufacture and gives possibility of a good abutment against the second abutment surface of the outer shell around the periphery of the entire outer shell.

Preferably, the spacer member is divided into two to eight segments. The division into segments makes the manufacture of the intermediate ring simpler. The intermediate ring also gets better ability to carry the forces that may arise when the circumference of the intermediate ring decreases or increases during the pressing-in between the outer shell and the frame.

According to a preferred embodiment, the spacer member has a first sliding surface, which forms an angle to the vertical plane of 0-20 degrees and which is arranged to slide against the second abutment surface on the outer shell upon the pressing-in of the spacer member. The first sliding surface makes it simple to press the spacer member in between the outer shell and the frame and simultaneously tighten the second abutment surface inwardly against the center of the crusher. According to an even more preferred embodiment, the first sliding surface forms an angle of 5-15 degrees to the vertical plane.

Preferably, the spacer member has a second sliding surface, which is arranged to slide against a second contact surface on the frame, which second contact surface is terminated by a shoulder protruding from the frame, the lower limitation, in the material flow direction, of the shoulder being situated substantially at the lower limitation, in the material flow direction, of the sliding surface. The shoulder has the advantage that possible deformation of the second contact surface that may arise during crushing is carried by the shoulder and does therefore not make the pressing-in of the spacer member more difficult when a new outer shell should be assembled.

Conveniently, the second contact surface of the frame forms an angle to the vertical plane of 0-10 degrees. This angle makes it simple to press the spacer member in between the frame and the outer shell. According to an even more preferred embodiment, the second contact surface is substantially vertical. A vertical second contact surface normally entails that smallest feasible force is required in order to press the spacer member in between the frame and outer shell.

According to a preferred embodiment, the upper portion, in the material flow direction, of the spacer member is protected by a replaceable protecting plate. The spacer member may in certain cases be exposed to the material, e.g. stone, which is to be crushed. It is then convenient to protect the exposed portion, normally the upper, with a protective plate. The protective plate is conveniently replaceable and formed from a material which resists wear, for instance gummed steel plate or sheet-metal plate of Hardox® steel.

According to a preferred embodiment, the spacer member has a mounting flange, which by means of mounting members is arranged to press the spacer member in between the second abutment surface of the outer shell and the frame and to fix the spacer member against the frame. The mounting flange has the advantage to work as holder for the mounting members, for instance mounting bolts, which are utilized for the pressing-in of the spacer member.

Another object of the present invention is to provide a spacer member for use in fixing of an outer shell in a gyratory crusher, which spacer member enables a flexible fixing, which is robust during crushing.

This object is attained by a spacer member for use in fixing of an outer shell in a frame included in a gyratory crusher, which outer shell is intended to, together with an inner shell, which is securable on a crushing head, define a crushing gap for receipt of material to be crushed in the crusher, the outer shell having a first abutment surface, which in a first fixing step has been brought to abutment against a first contact surface on the frame, and the spacer member being arranged to, in a second fixing step, be pressed in between a second abutment surface on the outer shell and the frame.

Additional advantages and features of the invention are seen in the description below and the appended claims.

BRIEF DESCRIPTION OF THE DRAWING

The invention will henceforth be described by means of embodiment examples and reference being made to the accompanying drawings.

DESCRIPTION OF PREFERRED EMBODIMENTS

Figure 1:
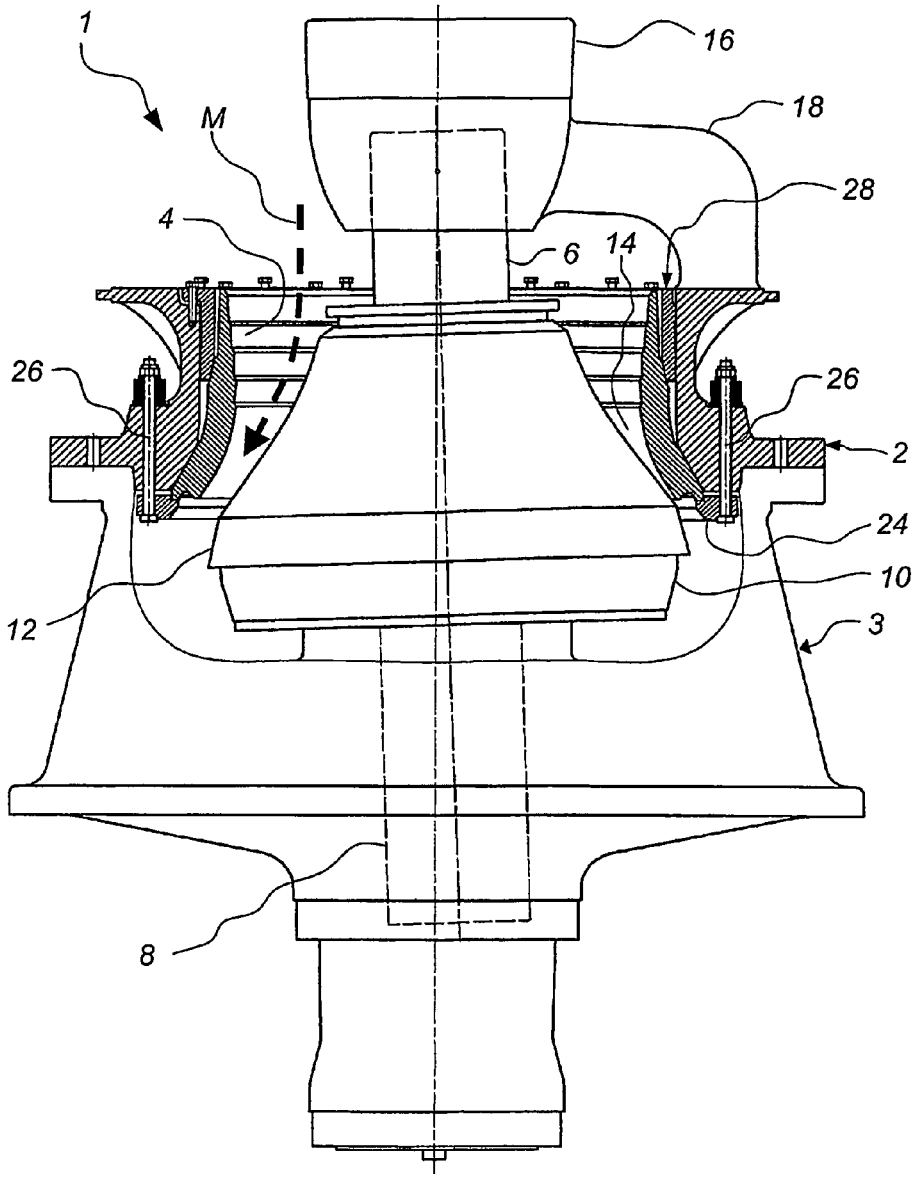
FIG. 1 is a side view, partly in section, and shows schematically a gyratory crusher.

In FIG. 1, a gyratory crusher 1 is shown schematically, which has a frame in the form of an upper part 2, which is detachably attached on a bottom part 3. In the upper part 2, a crushing shell in the form of an outer shell 4 is attached. The outer shell 4 is of a type, which is utilized in crushing of relatively rough material. The gyratory crusher 1 has also a shaft 6. At the lower end 8 thereof, the shaft 6 is eccentrically mounted in the bottom part 3. At the upper end thereof, the shaft 6 carries a crushing head 10. A second crushing shell in the form of an inner shell 12 is mounted on the outside of the crushing head 10. The outer shell 4 surrounds the inner shell 12 in such a way that between said shells 4, 12, a crushing gap 14 is formed, which in axial section, such as is shown in FIG. 1, has in direction downwardly decreasing width. The shaft 6, and thereby the crushing head 10 and the inner shell 12, is vertically movable by means of a hydraulic adjusting device, not shown. To the crusher a motor, not shown, is further connected, which is arranged to during the operation bring the shaft 6 and thereby the crushing head 10 to execute a gyratory movement, i.e., a movement during which the two crushing shells 4, 12 approach each other along a rotary generatrix and distance from each other at a diametrically opposite generatrix. In crushing, material will be supplied to the crusher 1 from above and be led downwardly in a material flow direction M while the material is crushed between the outer shell 4 and the inner shell 12.

Figure 2:
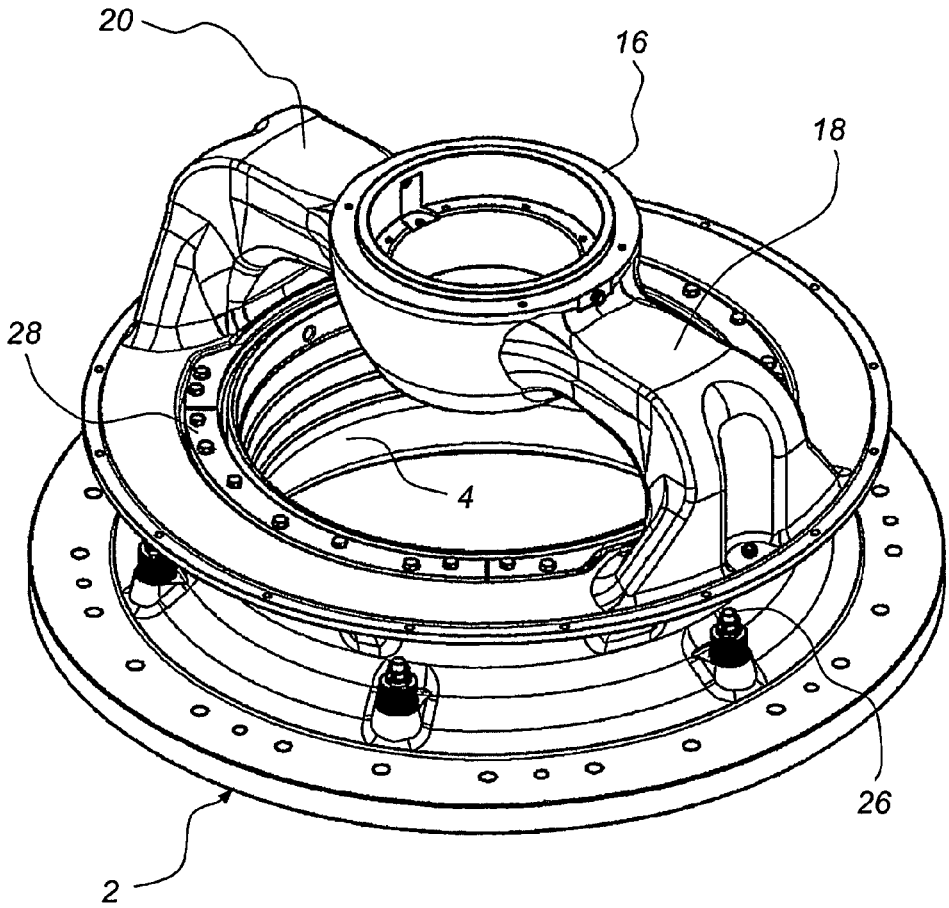
FIG. 2 is a perspective view taken obliquely from above and shows an upper part in the gyratory crusher shown in FIG. 1.

FIG. 2 shows the upper part 2 seen obliquely from above. The upper part 2 has a top mounting holder 16, which is held by two arms 18, 20 and which holds a mounting for the shaft 6. It will be appreciated that FIG. 1 accordingly does not show a straight section but a somewhat angled section through the upper part 2.

The outer shell 4 is kept at the lower end thereof, such as is shown in FIG. 1, in place by a clamping ring 24. The clamping ring 24 is clamped against the outer shell 4 and the upper part 2 by means of clamp bolts 26. A spacer member in the form of an intermediate ring 28 is utilized in a way that will be closer described for fastening of the outer shell 4 at the upper end thereof.

Figure 3:
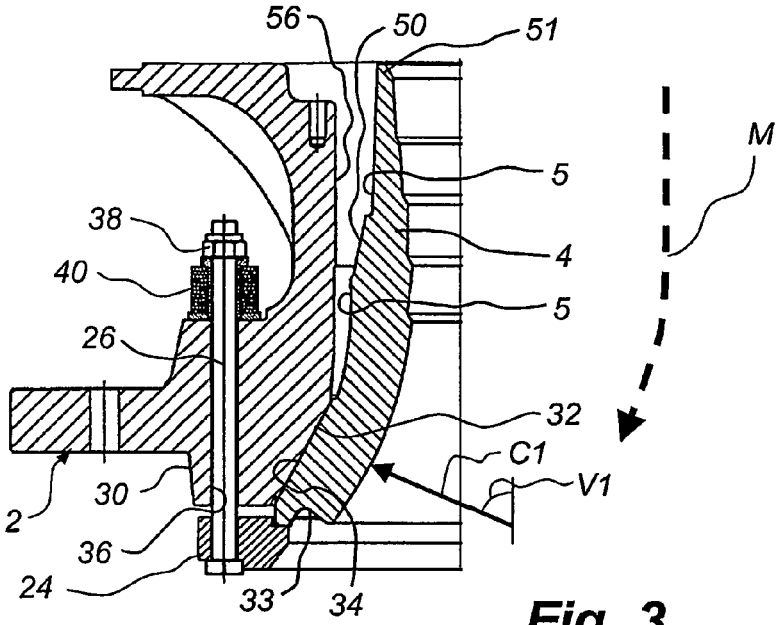
FIG. 3 is a section view and shows schematically a first step upon fastening of an outer shell in an upper part.

FIG. 3 shows a first step upon fastening of an outer shell 4 in an upper part 2. At the lower end 30 thereof, the upper part 2 has a first contact surface 32. The contact surface 32 forms an angle to the vertical plane of approx. 27 degrees. The outer shell 4 has at the lower end 33 thereof, seen in the material flow direction M, a first abutment surface 34 which is situated on the outer periphery of the outer shell 4 and which one also forms an angle to the vertical plane of 27 degrees. The shape of the outer shell 4 means that the crushing forces, symbolized by an arrow C1 in FIG. 3, which arise on a level with the first contact surface 32 in crushing of material between the outer shell 4 and the inner shell 12 will form an angle V1 of approx. 60 degrees to the vertical plane and accordingly be substantially perpendicular to the contact surface 32. During the first step in the fixing, the outer shell 4 is placed on the clamping ring 24 with the clamp bolts 26 assembled therein. The upper part 2 is then lowered down over the outer shell 4 and the clamp bolts 26 are brought through the mounting holes 36 in the upper part 2. The clamp bolts 26 are provided with tightening members comprising nuts 38 and tension springs 40. During tightening of the clamp bolts 26, the first abutment surface 34 will accordingly be brought to abutment against the contact surface 32 and to a certain extent slide along with the same when the outer shell 4 is forced upwards by the clamp bolts 26. A well clamped metallic abutment between the first abutment surface 34 of the outer shell 4 and the first contact surface 32 of the upper part 2 is thereby provided. Thanks to the contact surface 32 and the abutment surface 34 being angled, they will form cut off cones that are pressed into each other and give a stable clamping of the outer shell 4. When the clamp bolts 26 have been tightened to desired moment, the first step of the fixing of the outer shell 4 is terminated.

Figure 4:
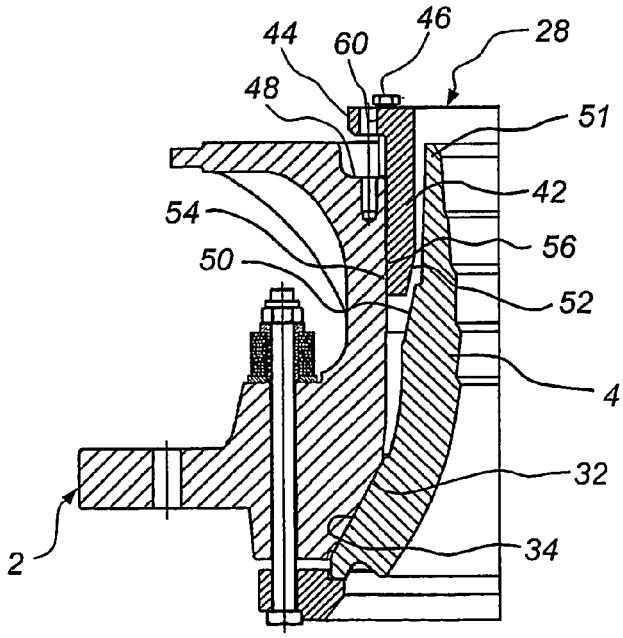
FIG. 4 is section view and shows schematically the beginning of a second step upon fastening of an outer shell in an upper part.

FIG. 4 shows the beginning of a second step upon fastening of an outer shell 4 in an upper part 2. The intermediate ring 28 has a web 42 and a flange 44 that is attached on the web 42. In the flange 44 of the intermediate ring 28, a number of disengagement bolts 46 sit. The disengagement bolts 46 are threaded into the flange 44 and support the intermediate ring 28 against a step 48 formed on the upper part 2. The outer shell 4 has a second abutment surface 50, which is situated on the outer periphery thereof, closer to the upper end 51 of the outer shell 4, seen in the material flow direction M, in relation to the first abutment surface 34. As is seen in FIG. 3, the second abutment surface 50 does not protrude from the outer periphery of the outer shell 4 but is situated substantially on a level with the portions on the periphery of the outer shell 4 that surround the second abutment surface 50. The second abutment surface 50 forms an angle of approx. 12 degrees to the vertical plane. The web 42 of the intermediate ring 28 has at the lower end thereof a first sliding surface 52, which one also forms an angle of 12 degrees to the vertical plane and which is arranged to slide against the second abutment surface 50. The web 42 has also a vertical second sliding surface 54 opposite the first sliding surface 52. The second sliding surface 54 is arranged to slide against a second contact surface 56 arranged on the upper part 2, which also is vertical. As is seen in FIG. 4, the web 42 has been brought down between the upper part 2 and the outer shell 4.

Figure 5:
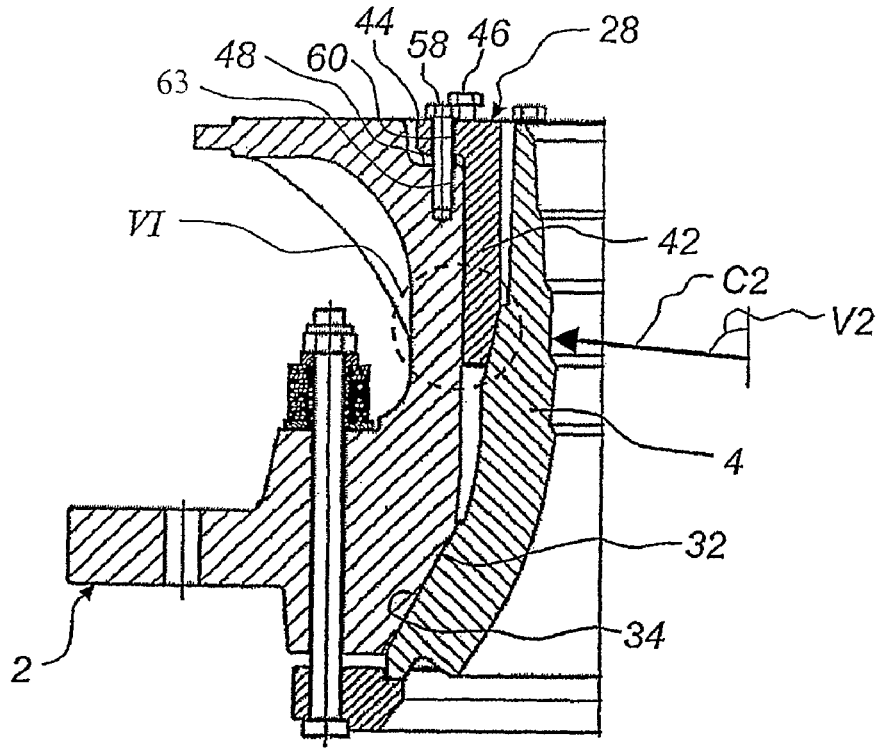
FIG. 5 is a section view and shows schematically the final phase of a second step upon fastening of an outer shell in an upper part.

FIG. 5 shows the final phase of a second step upon fastening of an outer shell 4 in an upper part 2. A number of mounting bolts 58 have been mounted in holes 60 in the flange 44. The mounting bolts 58 may, as alternative, be mounted in a non-tightened state already in the position, which is shown in FIG. 4 with the purpose of guiding the intermediate ring 28 in correct position. The mounting bolts 58 engage threaded holes 63 in the step 48. During this second step, the disengagement bolts 46 are first loosened so that the web 42 freely can be led down between the outer shell 4 and the upper part 2. When the first sliding surface 52 comes into contact with the second abutment surface 50, the mounting bolts 58 are gradually tightened in order to press the web 42 in between the upper part 2 and the outer shell 4, the first sliding surface 52 sliding against the second abutment surface 50 on the outer shell 4 and the second sliding surface 54 sliding against the second contact metallic abutment between the second abutment surface 50 of the outer shell 4 and the upper part 2 is thereby provided. When the mounting bolts 58 have been tightened to desired moment, the second step of the fixing of the outer shell 4 is terminated. The outer shell 4 is now secured at the upper part 2 by metallic abutments both at the first and the second abutment surface 34 and 50, respectively. The upper part 2 can now be lifted onto the bottom part 3 and be fastened on the same, wherein crushing can be begun.

When the outer shell 4 is to be disassembled, the upper part 2 is detached and lifted away from the bottom part 3. The mounting bolts 58 are loosened and possibly taken out from the holes 60 thereof. The disengagement bolts 46 are turned in such a way that they support against the step 48 and pull the flange 44 and thereby the web 42 upwards. When the intermediate ring 28 is released from the outer shell 4, the clamp bolts 26 and the clamping ring 24 are disassembled, wherein the outer shell 4 can be knocked loose from the upper part 2. It is not necessary to entirely disassemble the intermediate ring 28 before a new outer shell 4 is assembled in the upper part 2, but it is enough that the intermediate ring 28 with the disengagement bolts 46 is lifted to a position where the outer shell 4 in the first step can be clamped inwards towards the first abutment surface 34 thereof without influence from the intermediate ring 28. It may also be an advantage to let the bolts 58 remain in a non-tightened state in order to hold the intermediate ring 28 in position on the upper part 2 at the prospect of the next fastening of an outer shell. In certain cases it is possible, as alternative to the above-described method, to first loosen the clamping ring 24, the outer shell 4 directly loosening from the upper part 2 and the intermediate ring 28, which then is loosened in order to enable assembly of a new outer shell.

The shape of the outer shell 4 means that the crushing forces, symbolized by an arrow C2 in FIG. 5, which arise on a level with the second contact surface 50 in crushing of material between the outer shell 4 and the inner shell 12 will form an angle V2 of approx. 80 degrees to the vertical plane and accordingly be substantially perpendicular to the first sliding surface 52.

Figure 6:
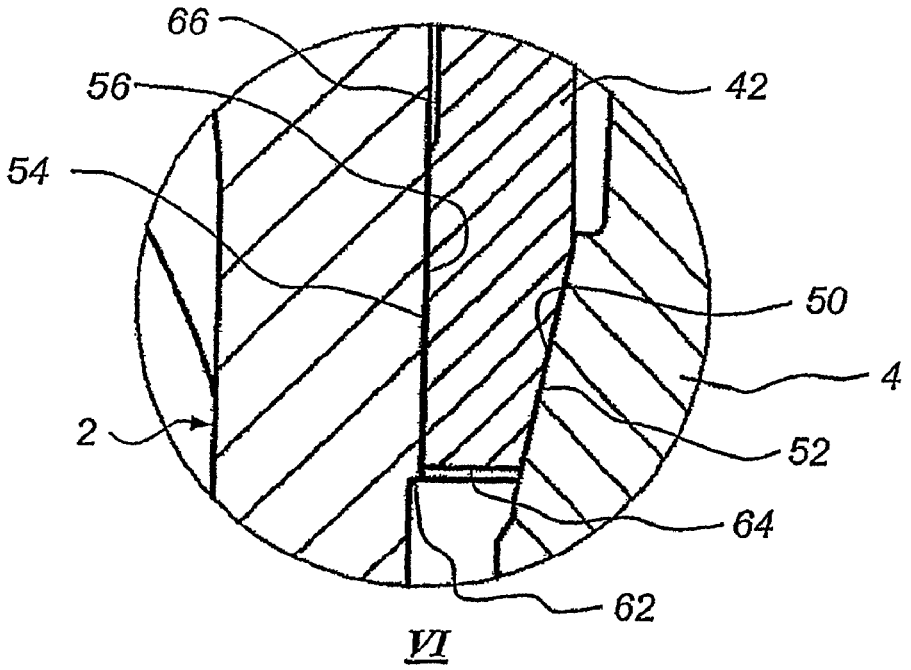
FIG. 6 is a partial enlargement in section and shows the area VI shown in FIG. 5.

FIG. 6 shows an enlargement of the area VI shown in FIG. 5. As can be seen, the second contact surface 56 is terminated by a shoulder 62 protruding from the upper part 2. During operation, the mechanical impact of the crushing forces may lead to the second sliding surface 54 being pressed into and deforming the second contact surface 56. The deformation may produce a step on the contact surface 56, which step may work as an obstacle next time the intermediate ring 28 is to be pressed in between the upper part 2 and an outer shell 4. As is shown in FIG. 6, a possible deformation of the lower portion of the contact surface 56 will produce a very narrow step precisely at the shoulder 62. Such a step may simply be ground away immediately before the next pressing-in of the intermediate ring 28. It will be appreciated that, depending on the pressing-in position of the intermediate ring 28, the lower portion 64 of the web 42 can end up immediately above the shoulder 62, as is shown in FIG. 6, precisely in line with the shoulder 62 or immediately underneath the shoulder 62. When the lower portion 64 ends up in line with the shoulder 62, no step at all is formed and when the lower portion 64 ends up immediately underneath the shoulder 62 a smaller step, which is easy to grind away, may be formed on the second sliding surface 54. Thus, in all cases the shoulder 62 entails that the deformation that may be caused by the crushing forces does not result in any substantial increase of the downtime in connection with exchange of outer shell.

It is also seen from FIG. 6 that a recess 66 has been formed in the web 42 above, seen in the material flow direction, the second sliding surface 54 of the web 42. The purpose of the recess 66 is to decrease the surface on the web 42 that has to be machined to high accuracy of tolerance in order to form the second sliding surface 54.

The vertical contact between the second sliding surface 54 and the second contact surface 56 makes that the intermediate ring 28 easily can be adjusted in the vertical direction without any change of diameter. The web 42, the first sliding surface 52 of which forms an angle to the vertical plane, will have the function of a wedge, which is pressed down between the second contact surface 56 of the upper part 2 and the second abutment surface 50 of the outer shell 4 and clamps the abutment surface 50 inwardly against the center of the crusher.

Figure 7:
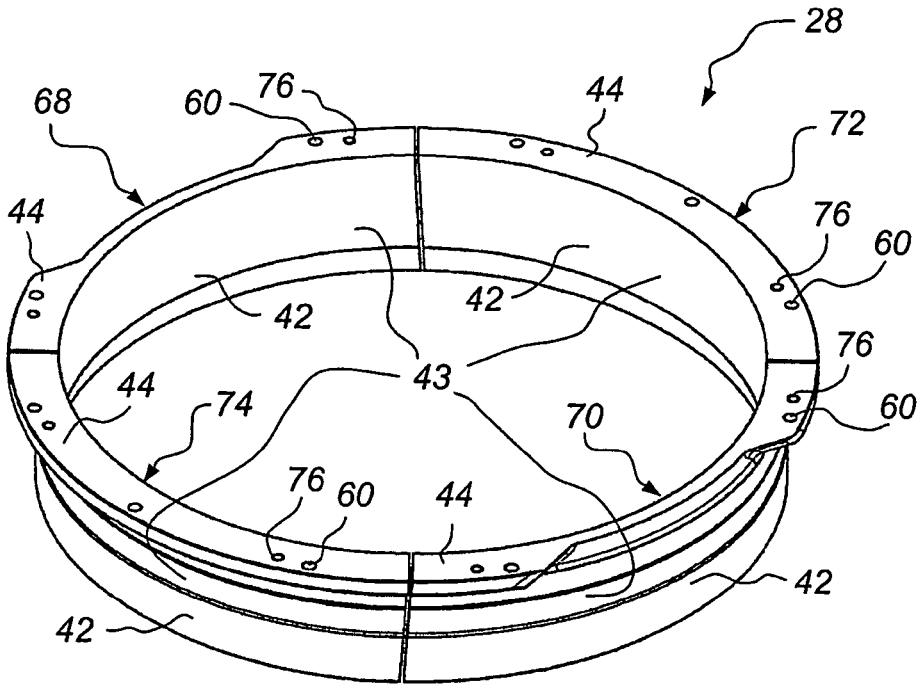
FIG. 7 is a perspective view and shows a spacer member in the form of an intermediate ring.

FIG. 7 is a perspective view of the intermediate ring 28. The intermediate ring 28 has two first segments 68, 70 which are intended to sit below the arms 18, 20 of the upper part 2, and two second segments 72, 74, which are intended to sit between the arms 18, 20. Each segment 68, 70, 72, 74 has a web 42 and a flange 44 as well as holes 76 for the disengagement bolts 46 and holes 60 for the mounting bolts 58. The segments 68, 70, 72, 74 are spaced apart by thin gaps which are sealed with, for instance, sealing compound. As can be seen in FIG. 7, the webs 42 of the segments 68, 70, 72, 74 together form a tubular part in the form of a segmented circular sleeve 43 that is intended to be pressed down between the frame 2 and the outer shell 4 along the periphery thereof.

The outer shell 4 is conveniently cast in a hard and wear-resisting material, for instance manganese steel (also called Hadfield steel), which is suitable for crushing. The upper part 2 is conveniently cast in carbon steel or spheroidal graphite iron. The intermediate ring 28 is conveniently formed from a metallic material, which is easy to machine to narrow tolerances and which gives a good support to the outer shell. Convenient materials in the intermediate ring 28 are, for instance, carbon steel or spheroidal graphite iron.

Figure 8:
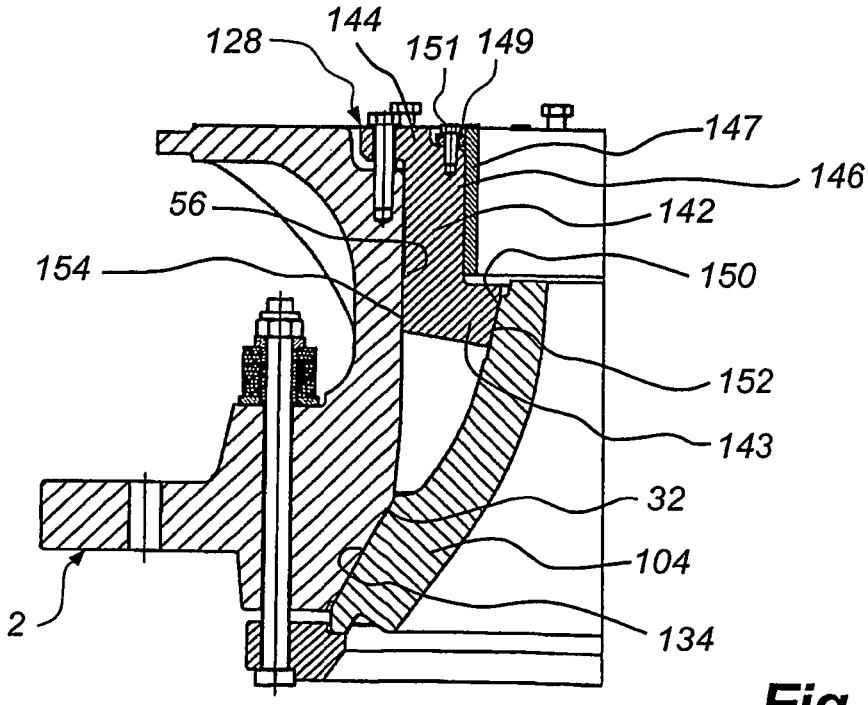
FIG. 8 is a section view and shows an intermediate ring as well as an outer shell according to a second embodiment.
Figure 9:
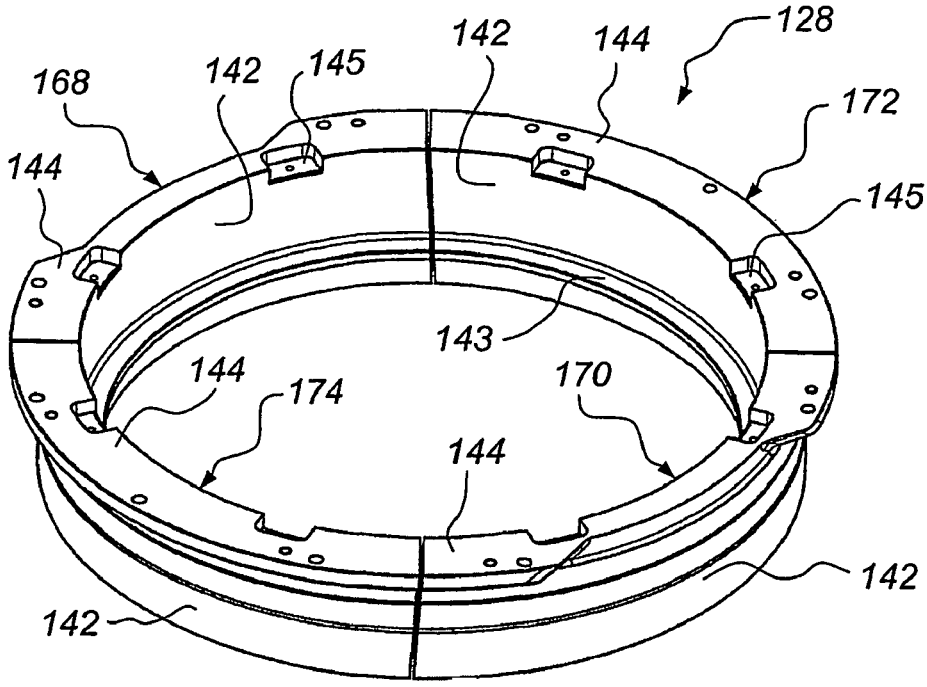
FIG. 9 is a perspective view and shows the intermediate ring shown in FIG. 8.

FIG. 8 shows a second embodiment in the form of an intermediate ring 128. The intermediate ring 128 is utilized when an outer shell 104, which has shorter extension in the vertical direction and which extends longer inwards towards the center of the crusher 1, should be assembled in the upper part 2. The outer shell 104 is of a type that is utilized in crushing of relatively fine-grained material. The outer shell 104 has a first abutment surface 134, which in a first fixing step is brought to abutment against the first contact surface 32 of the upper part 2 in the same way as has been described above with reference to FIG. 3. The outer shell 4 has also a second abutment surface 150 that forms an angle of approx. 12 degrees to the vertical plane. The intermediate ring 128 has a web 142 and a flange 144. The web 142 has at the lower end thereof a bulging 143 which on the side that faces the outer shell 104 carries a first sliding surface 152, which is arranged to slide against the second abutment surface 150 when the web 142 in a second fixing step is pressed in between the outer shell 104 and the upper part 2. On a side opposite the sliding surface 152, there is a second sliding surface 154 that is arranged to slide against the second contact surface 56 on the upper part 2. Thus, the intermediate ring 128 makes it possible to in the upper part 2 simply and without extensive reconstructions assemble an outer shell 104, which has another geometry and another function in the crushing than the outer shell 4 shown in FIG. 1. In the upper edge of the flange 144 a number of fixing recesses 145 have been formed, which is best seen in FIG. 9. A protective plate 147, which runs along the upper portion 146 of the web 142 and protects the same against hits by stones etc., is by means of fastening ears 149 and bolts 151 attached in the intermediate ring 128.

FIG. 9 shows a number of segments 168, 170, 172, 174 that together form the intermediate ring 128. In FIG. 9 is also seen even more clearly the fixing recesses 145 which have been formed in the flange 144 so that the protective plate 147, which conveniently is divided into a number of segments, should be able to be assembled.

Figure 10:
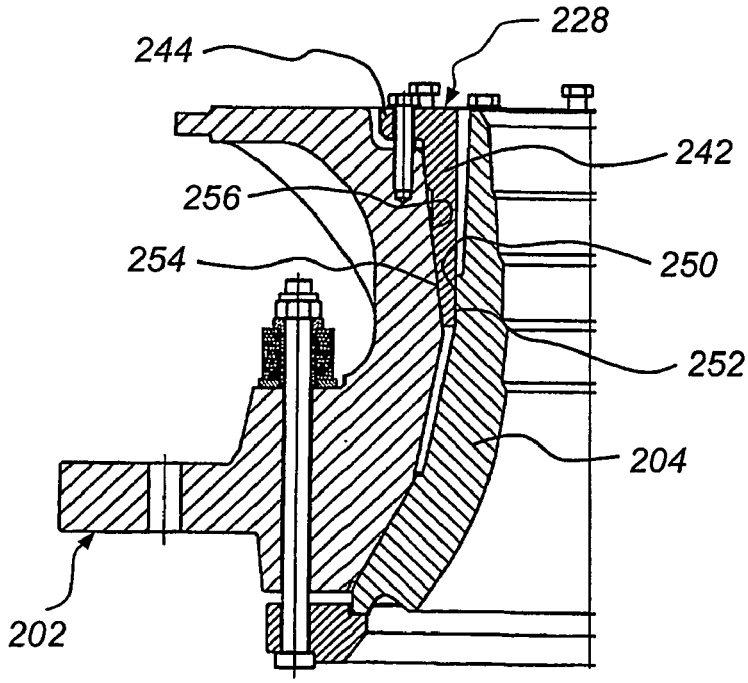
FIG. 10 is a section view and shows a third embodiment of an intermediate ring as well as an outer shell.

FIG. 10 shows an additional alternative embodiment in the form of an intermediate ring 228 that is utilized for fixing of an outer shell 204. The outer shell 204 is of substantially the same type as the one shown in FIG. 3, but has a vertical second abutment surface 250. The intermediate ring 228 has a web 242 and a flange 244. The web 242 has at the lower end thereof a first sliding surface 252, which is vertical and arranged to slide against the second abutment surface 250 when the web 242 in a second fixing step is pressed in between the outer shell 204 and an upper part 202. On a side opposite the sliding surface 252, there is a second sliding surface 254, which is arranged to slide against a second contact surface 256 on the upper part 202. The second sliding surface 254 as well as the second contact surface 256 forms an angle of approx. 1-2 degrees to the vertical plane. Thus, in the embodiment shown in FIG. 10 an upper part 202 is utilized having an angled second contact surface 256 along which the second sliding surface 254 of the intermediate ring 228 slides when the intermediate ring 228 is pressed down between the outer shell 204 and the upper part 202.

Figure 11:
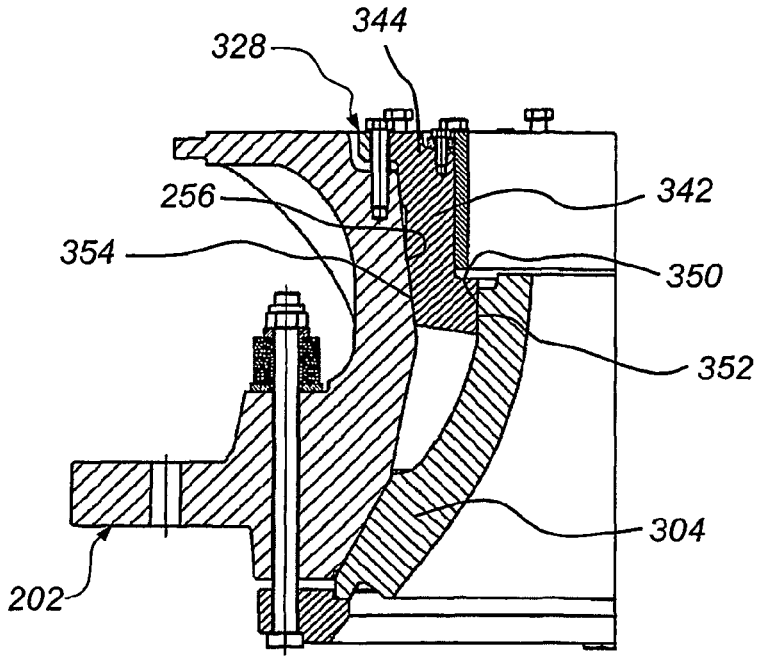
FIG. 11 is a section view and shows an alternative embodiment of the intermediate ring as well as the outer shell shown in FIG. 8.

FIG. 11 shows an additional alternative embodiment in the form of an intermediate ring 328 that is utilized for fixing of an outer shell 304. The outer shell 304 is of substantially the same type as the outer shell 104 that is shown in FIG. 8, but has a vertical second abutment surface 350 and is adapted for fixing in the upper part 202 that is shown in FIG. 10. Thus, the intermediate ring 328 has a flange 344 and a web 342, the first sliding surface 352 of which is vertical and arranged to slide against the second abutment surface 350 when the web 342 in a second fixing step is pressed in between the outer shell 304 and the upper part 202. On a side opposite the sliding surface 352, there is a second sliding surface 354 which like the second contact surface 256 forms an angle of approx. 1-2 degrees to the vertical plane.

Figure 12:
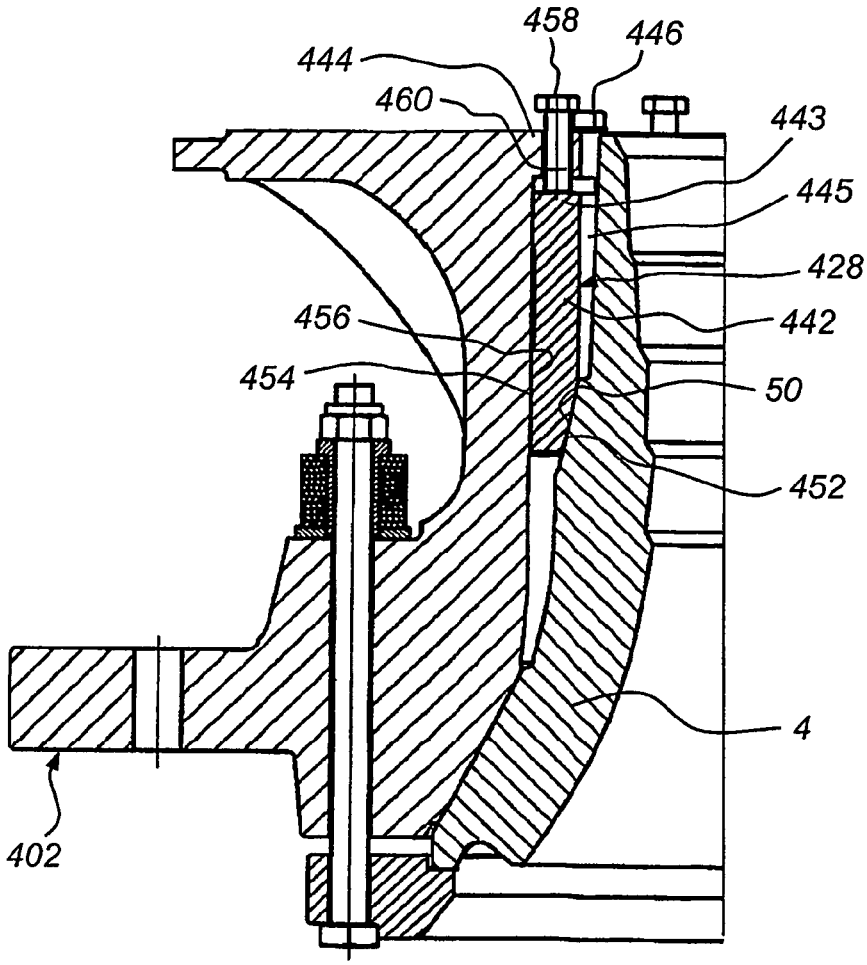
FIG. 12 is a section view and shows a fourth embodiment of an intermediate ring.

FIG. 12 shows an alternative embodiment of an intermediate ring 428 for fastening of the outer shell 4 shown in FIG. 3 in an upper part 402. The intermediate ring 428 differs from the intermediate ring 28 shown in FIG. 4 in that the intermediate ring 428 has a web 442 but lacks flange. The web 442 has at the lower end thereof a first sliding surface 452, which forms an angle of 12 degrees to the vertical plane and which is intended to upon fixing of the outer shell 4 slide against the second abutment surface 50. On a side opposite the sliding surface 452, there is a vertical second sliding surface 454 that is arranged to slide against a vertical second contact surface 456 on the upper part 402. The upper part 402 has a flange 444 which extends out above the space 445 that is formed between the outer shell 4 and the second contact surface 456. The flange 444 has a number of holes 460 in which mounting bolts 458 are threaded. The mounting bolts 458 support against the upper portion 443 of the web 442 and will when they are tightened press the web 442 in between the upper part 402 and the outer shell 4. The flange 444 has also a number of unthreaded holes in which disengagement bolts 446 are placed, which are threaded in the upper portion 443 of the web 442. When the intermediate ring 428 is to be released, the mounting bolts 458 are first loosened and then the disengagement bolts 446 are turned in order to pull up and release the web 442. The intermediate ring 428 has a very simple construction since it lacks flange. However, the intermediate ring has to be placed in position below the flange 444 of the upper part 402 before the upper part 402 can be lowered down over the outer shell 4.

Figure 13:
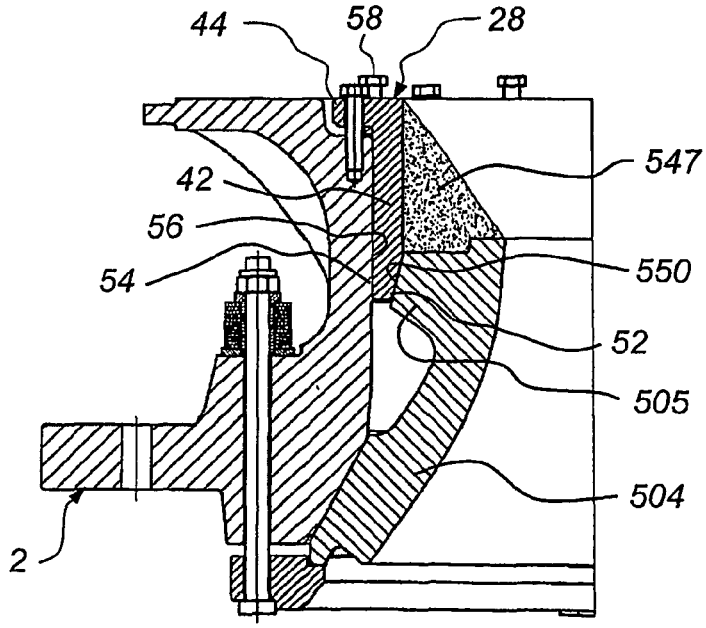
FIG. 13 is a section view and shows an alternative embodiment of the outer shell shown in FIG. 8.

FIG. 13 shows an alternative embodiment of an outer shell 504 for fixing in an upper part 2. The outer shell 504 has a similar function in the crushing as the outer shells 104 and 304, respectively, shown in FIGS. 8 and 11, and is accordingly intended for crushing of relatively fine-grained material. On the upper, outer periphery thereof, the outer shell 504 is provided with a circumferential rib 505. The outer shell 4 has a second abutment surface 550, which is situated on the outer periphery of the rib 505. Upon fixing of the outer shell 504, the same intermediate ring 28 is in the second step utilized as is described above with reference to FIGS. 3-5. Utilization of a rib 505 on the periphery of the outer shell 504 and the intermediate ring 28 is accordingly an alternative to utilization of an outer shell 104 without rib together with the intermediate ring 128 with the bulging 143. However, for casting-technical reasons it is frequently advantageous to avoid ribs on the outer shell.

As is seen in FIG. 13, a material shelf 547 has been formed on top of the rib 505. The material shelf 547 consists of material which during the crushing has been accumulated on the rib and which now forms a protection for the intermediate ring 28. The material shelf 547 may in certain cases, depending on the properties of the material and if it can construct a protective shelf, be an alternative to the protective plate 147 shown in FIG. 8.

Figure 14:
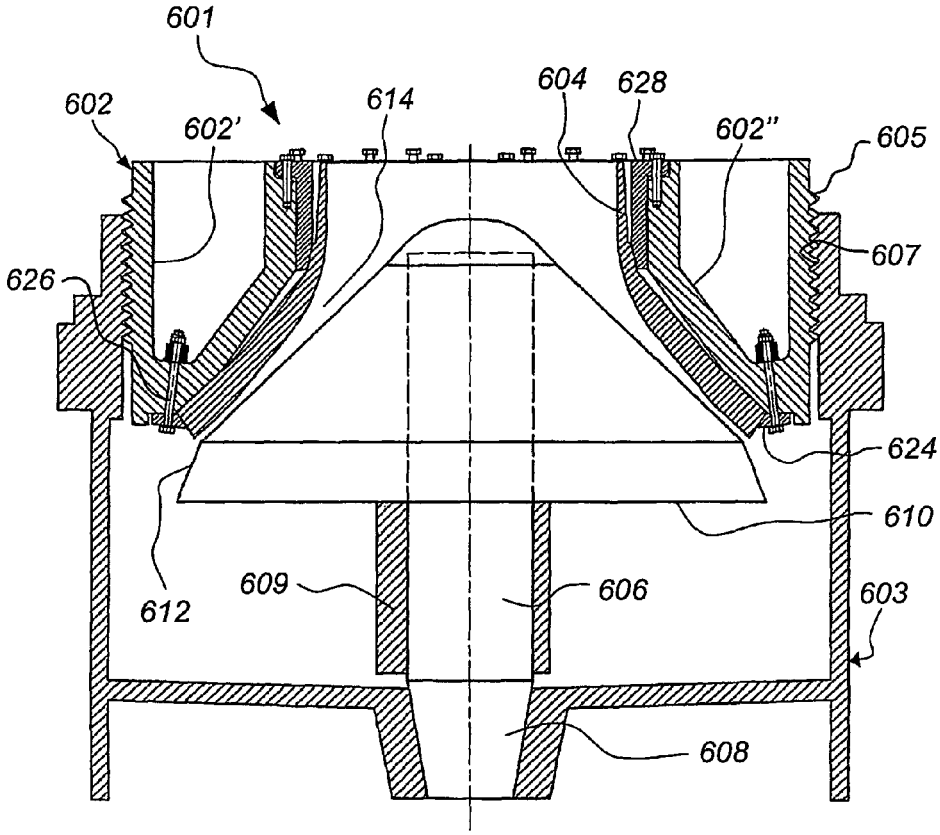
FIG. 14 is a side view, partly in section, and shows a gyratory crusher having mechanical adjustment of the width of the gap.

FIG. 14 shows schematically a gyratory crusher 601, which is of another type than the crusher shown in FIG. 1. The gyratory crusher 601 shown in FIG. 14 has a frame in the form of a sleeve 602. The sleeve 602 has a cylindrical outer part 602', which externally has a thread 605. The thread 605 fits in a corresponding thread 607 in a bottom part 603. The sleeve 602 has also a partly cone-shaped interior part 602" in which an outer shell 604 is attached. The gyratory crusher 601 also has a shaft 606 that above the lower portion 608 thereof is eccentrically mounted in a mounting 609. At the upper end thereof, the shaft 606 carries a crushing head 610 on which an inner shell 612 is mounted. Between the shells 604, 612, a crushing gap 614 is formed, which in axial section, as is shown in FIG. 14, has in downward direction decreasing width. Furthermore, to the crusher 601 a motor, not shown, is connected, which is arranged to during the operation bring the shaft 606 and thereby the crushing head 610 to execute a gyratory movement. When the sleeve 602 is turned around the symmetry axis thereof, the outer shell 604 will be moved vertically, the width for the gap 614 being changed. That is, on this type of gyratory crusher 601, the sleeve 602 and the threads 605, 607 constitute an adjusting device for adjustment of the width of the gap 614.

The outer shell 604 is at the lower end thereof clamped by a clamping ring 624. The clamping ring 624 is clamped against the outer shell 604 and the sleeve 602 by means of clamp bolts 626. A spacer member in the form of an intermediate ring 628 has, after the clamping ring 624 has clamped the outer shell 604 at the lower end thereof, been pressed down between the interior part 602" of the sleeve 602 and the outer shell 604 at the upper end thereof. The intermediate ring 628 shown in FIG. 14 is of similar type and has substantially the same function as the intermediate ring 28 which is described above with reference to FIGS. 1-6. It will be appreciated that also other types of intermediate rings may be used in crushes of the type which is shown in FIG. 14.

It will be appreciated that a variety of modifications of the above-described embodiments are feasible within the scope of the claims.

Thus, it is not necessary to divide the intermediate ring 28 into four segments 68, 70, 72, 74. For instance, the intermediate ring may have 2, 6 or 8 segments. It is also possible to manufacture the intermediate ring in one single piece. The latter may, however, be disadvantageous for both manufacturing and mounting-technical reasons.

The invention may be utilized also when the first abutment surface and second abutment surface of the outer shell form the same angle to the vertical plane and also when the first and second abutment surface form truncated conical rings on the same conceived right cone. Thus, in such cases, also the first contact surface of the upper part and the first sliding surface of the intermediate ring form the same angle to the vertical plane. The invention is, however, as previously has been mentioned, especially advantageous in the case when the first abutment surface and the second abutment surface form different angles to the vertical plane.

It is also possible to instead of an intermediate ring use a spacer member which is in the form of a number of thin segments (similar to wedges), which are located at a certain distance from each other and each one of which may have the same cross-section as the above-described intermediate rings. Said thin segments abut, however, together only against approx. 50% or less of the circumference of the second abutment surface of the outer shell. Thus, 8-12 thin segments may, for instance, be used, each one of which may have the same cross-section as the intermediate ring shown in FIG. 4 and which are evenly distributed around the periphery of the outer shell. However, the intermediate ring has the advantage that it gives a more even support to the outer shell around the periphery thereof since the intermediate ring abuts against more than 95% of the circumference of the second abutment surface of the outer shell.

In FIG. 1, a gyratory crusher 1 is shown, which is of a type where the position of the inner shell 12 is vertically adjusted by means of a hydraulic adjusting device. In FIG. 14 a gyratory crusher 601 is shown, which is of a type in which the position of the outer shell 604 is vertically adjusted by means of a sleeve 602, which has an external thread 605. It will be appreciated that the present invention also is applicable to other types of gyratory crushes. One example is gyratory crushes which are of a type where the position of the outer shell is vertically adjusted by means of a hydraulic adjusting device, e.g., a number of hydraulic cylinders, as is shown in U.S. Pat. No. 2,791,383. In this type of crushes, hydraulic cylinders, or the like members, act between the bottom part of the crusher and a frame in the form of a sleeve that carries the outer shell.

The invention claimed is:

1. Outer shell for fixing in a gyratory crusher that includes a frame, the outer shell, and an inner shell, which is securable on a crushing head in order to, together with the outer shell, define a crushing gap for receipt of material to be crushed, comprising:

a first abutment surface, which is configured to abut against a first contact surface on the frame, wherein the first abutment surface forms an angle to a vertical plane of 10-55 degrees, and a second abutment surface that is configured to engage with a spacer member that is possible to press between the frame and the second abutment surface, wherein the second abutment surface forms an angle to a vertical plane of 0-20 degrees and is configured to slide against a first sliding surface on the spacer member, and wherein there is at least one surface along the outer shell between the first and second abutment surfaces that forms an angle to a vertical plane of 0 to 55 degrees and the angle is different than the angle for either the first or second abutment surface.

2. Outer shell according to claim 1, wherein said first abutment surface is situated at the lower end of the outer shell, said second abutment surface being situated closer to the upper end of the outer shell.

3. Outer shell according to claim 1, wherein the second abutment surface is substantially perpendicular to the main direction of the crushing forces that during operation arise in plane with the second abutment surface.

4. Outer shell according to claim 1, wherein the first abutment surface forms a substantially right angle to the main direction of the crushing forces that during operation arise in plane with the first abutment surface.

5. Outer shell according to claim 1, wherein the second abutment surface is situated substantially on a level with the portions of the periphery of the outer shell that surround the second abutment surface.

6. Gyratory crusher comprising:

a frame;

an outer shell, which is securable in the frame; and an inner shell, which is securable on a crushing head in order to, together with the outer shell, define a crushing gap for receipt of material to be crushed when flowing through the gap, wherein the outer shell of the crusher has an outer surface that includes a first abutment surface that contacts a first contact surface on the frame, and a second abutment surface that contacts spacer member in between the frame and the second abutment surface, and wherein a portion of the outer surface of the outer shell between the first and second abutment surfaces does not contact the frame or spacer member, and wherein the second abutment surface forms an angle to a vertical plane of 0-20 degrees.

7. Gyratory crusher according to claim 6, wherein said first abutment surface is situated at the lower end of the outer shell seen in a material flow direction, said second abutment surface being situated closer to the upper end of the outer shell seen in the material flow direction.

8. Gyratory crusher according to claim 6, wherein the spacer member is an intermediate ring, which has a substantially tubular part, which is intended to be pressed in between the second abutment surface of the outer shell and a second contact surface on the frame.

9. Gyratory crusher according to claim 6, wherein the spacer member is divided into two to eight segments.

10. Gyratory crusher according to claim 6, wherein the spacer member has a first sliding surface, which forms an angle to the vertical plane of 0-20 degrees and which is arranged to slide against the second abutment surface on the outer shell upon pressing-in of the spacer member.

11. Gyratory crusher according to claim 6, wherein the spacer member has a second sliding surface, which is arranged to slide against a second contact surface on the frame, which second contact surface is terminated by a shoulder protruding from the frame, the lower limitation, in the material flow direction, of the shoulder being situated substantially at the lower limitation, seen in the material flow direction, of the sliding surface.

12. Gyratory crusher according to claim 11, wherein the second contact surface of the frame forms an angle to the vertical plane of 0-10 degrees.

13. Gyratory crusher according to claim 6, wherein the upper portion, in the material flow direction, of the spacer member is protected by a replaceable protecting plate.

14. Gyratory crusher according to claim 6, wherein the spacer member has a mounting flange, which by means of mounting members is arranged to press the spacer member in between the second abutment surface of the outer shell and the frame and to secure the spacer member against the frame.

* * * * *